US006459375B1

(12) United States Patent
Wallace

(10) Patent No.: US 6,459,375 B1
(45) Date of Patent: Oct. 1, 2002

(54) ELECTRONIC MAIL SENSOR

(76) Inventor: Carolyn Wallace, 387 Rood Ave., Windsor, CT (US) 06095

( * ) Notice: Subject to any disclaimer, the term of this patent is extended or adjusted under 35 U.S.C. 154(b) by 0 days.

(21) Appl. No.: 09/815,714

(22) Filed: Mar. 23, 2001

(51) Int. Cl.[7] ..... G08B 13/14
(52) U.S. Cl. ..... 340/569; 340/570
(58) Field of Search ..... 340/569, 570, 340/572.4, 689, 545

(56) References Cited

U.S. PATENT DOCUMENTS

| | | | | |
|---|---|---|---|---|
| 3,909,819 A | | 9/1975 | Radford | |
| 4,520,350 A | | 5/1985 | Huang | |
| 4,868,543 A | | 9/1989 | Binkley | |
| 4,868,563 A | * | 9/1989 | Stair et al. | 340/765 |
| 4,872,210 A | * | 10/1989 | Benages | 340/569 |
| 5,023,595 A | | 6/1991 | Bennett | |
| D350,298 S | | 9/1994 | Horton | |
| 5,440,294 A | | 8/1995 | Mercier et al. | |
| 6,046,675 A | * | 4/2000 | Hanna | 340/569 |
| 6,275,154 B1 | * | 8/2001 | Bennett et al. | 340/569 |

* cited by examiner

*Primary Examiner*—Van Trieu

(57) ABSTRACT

An electronic mail sensor for informing a user when something has been put into a mailbox includes a door coupled to a mailbox for selectively covering an open end of the mailbox. A transmitter assembly is coupled to the mailbox adjacent the open end and includes a sensor for detecting when the door is in an open position. The transmitter assembly further includes a transmitter operationally coupled to the sensor for transmitting a signal when the door is in an open position. A receiver assembly includes a receiver for receiving the signal, the receiver assembly includes a mail indicating light operationally coupled to the receiver such that the mail indicating light is illuminated upon the receiver receiving the signal.

15 Claims, 4 Drawing Sheets

ELECTRONIC MAIL SENSOR

BACKGROUND OF THE INVENTION

1. Field of the Invention

The present invention relates to mail delivery indicating systems and more particularly pertains to a new electronic mail sensor for informing a user when something has been put into a mailbox.

2. Description of the Prior Art

The use of mail delivery indicating systems is known in the prior art. More specifically, mail delivery indicating systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,023,595; U.S. Pat. No. 4,520,350; U.S. Pat. No. 4,868,543; U.S. Pat. No. 5,440,294; U.S. Pat. No. 3,909,819; and U.S. Pat. No. Des. 350,298.

While these devices fulfill their respective, particular objectives and requirements, the aforementioned patents do not disclose a new electronic mail sensor. The inventive device includes a mailbox that has an open end. A door is coupled to the mailbox for selectively covering the open end. A transmitter assembly coupled to the mailbox adjacent the open end, the transmitter assembly includes a sensor for detecting the door is in an open position. The transmitter assembly further includes a transmitter operationally coupled to the sensor for transmitting a signal when the door is in an open position. A receiver assembly includes a receiver for receiving the signal, the receiver assembly includes a mail indicating light operationally coupled to the receiver such that the mail indicating light is illuminated upon the receiver receiving the signal.

In these respects, the electronic mail sensor according to the present invention substantially departs from the conventional concepts and designs of the prior art, and in so doing provides an apparatus primarily developed for the purpose of informing a user when something has been put into a mailbox.

SUMMARY OF THE INVENTION

In view of the foregoing disadvantages inherent in the known types of mail delivery indicating systems now present in the prior art, the present invention provides a new electronic mail sensor construction wherein the same can be utilized for informing a user when something has been put into a mailbox.

The general purpose of the present invention, which will be described subsequently in greater detail, is to provide a new electronic mail sensor apparatus and method which has many of the advantages of the mail delivery indicating systems mentioned heretofore and many novel features that result in a new electronic mail sensor which is not anticipated, rendered obvious, suggested, or even implied by any of the prior art mail delivery indicating systems, either alone or in any combination thereof.

To attain this, the present invention generally comprises A door is coupled to the mailbox for selectively covering the open end. A transmitter assembly coupled to the mailbox adjacent the open end, the transmitter assembly includes a sensor for detecting the door is in an open position. The transmitter assembly further includes a transmitter operationally coupled to the sensor for transmitting a signal when the door is in an open position. A receiver assembly includes a receiver for receiving the signal, the receiver assembly includes a mail indicating light operationally coupled to the receiver such that the mail indicating light is illuminated upon the receiver receiving the signal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electronic mail sensor apparatus and method which has many of the advantages of the mail delivery indicating systems mentioned heretofore and many novel features that result in a new electronic mail sensor which is not anticipated, rendered obvious, suggested, or even implied by any of the prior art mail delivery indicating systems, either alone or in any combination thereof.

It is another object of the present invention to provide a new electronic mail sensor, which may be easily and efficiently manufactured and marketed.

It is a further object of the present invention to provide a new electronic mail sensor, which is of a durable and reliable construction.

An even further object of the present invention is to provide a new electronic mail sensor which is susceptible of a low cost of manufacture with regard to both materials and labor, and which accordingly is then susceptible of low prices of sale to the consuming public, thereby making such electronic mail sensor economically available to the buying public.

Still yet another object of the present invention is to provide a new electronic mail sensor which provides in the apparatuses and methods of the prior art some of the advantages thereof, while simultaneously overcoming some of the disadvantages normally associated therewith.

Still another object of the present invention is to provide a new electronic mail sensor for informing a user when something has been put into a mailbox.

Yet another object of the present invention is to provide a new electronic mail sensor which includes a door that is coupled to a mailbox for selectively covering an open end of the mailbox. A transmitter assembly is coupled to the mailbox adjacent the open end, the transmitter assembly includes a sensor for detecting when the door is in an open position. The transmitter assembly further includes a transmitter operationally coupled to the sensor for transmitting a signal when the door is in an open position. A receiver assembly includes a receiver for receiving the signal, the receiver assembly includes a mail indicating light operationally coupled to the receiver such that the mail indicating light is illuminated upon the receiver receiving the signal.

Still yet another object of the present invention is to provide a new electronic mail sensor that would notify a user that mail has been delivered, saving the user time and unneeded trips to the mailbox, especially helpful for elderly or handicapped persons.

Even still another object of the present invention is to provide a new electronic mail sensor that would be easy to install and maintain.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
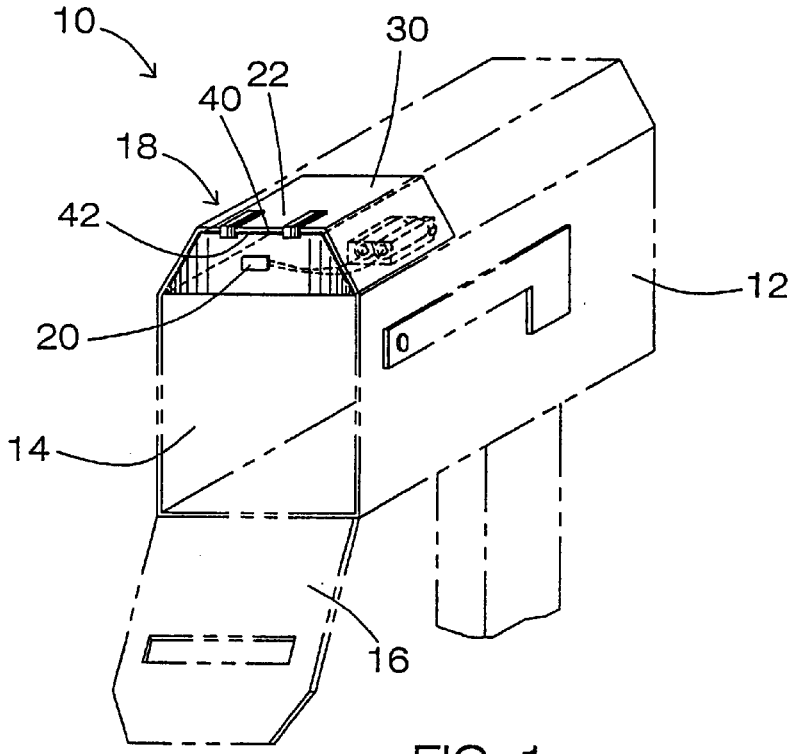
FIG. 1 is a perspective view of a new electronic mail sensor according to the present invention.
Figure 2:
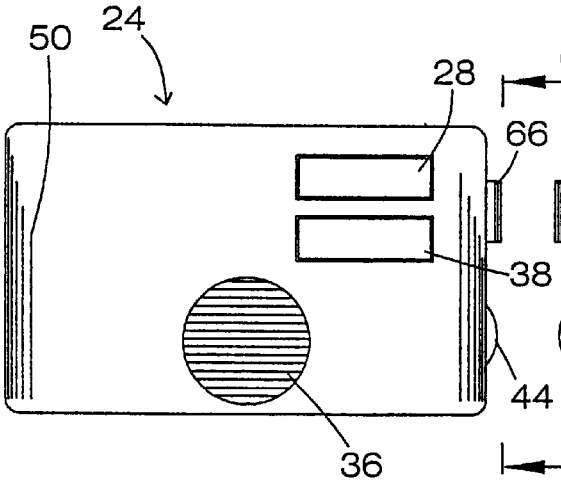
FIG. 2 is a front view of an embodiment of the receiver of the present invention.
Figure 3:
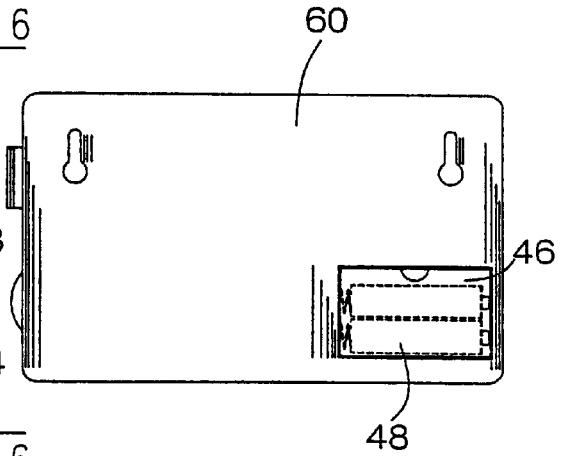
FIG. 3 is a rear view of an embodiment of the receiver of the present invention.
Figure 4:
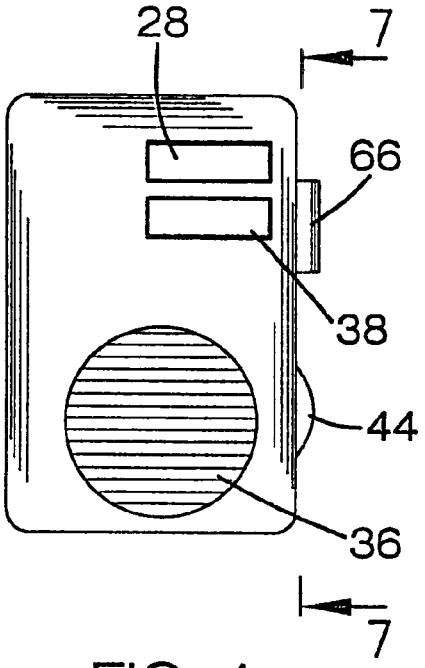
FIG. 4 is a front view of an embodiment of the receiver of the present invention.
Figure 5:
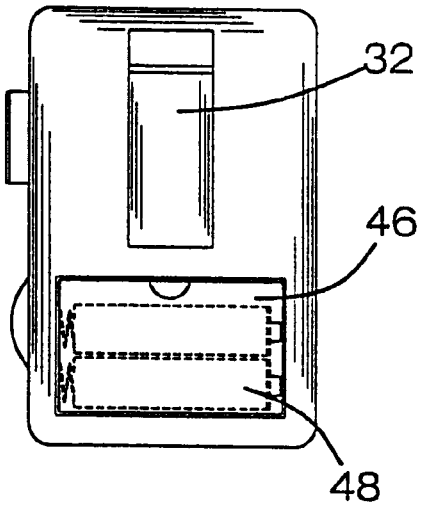
FIG. 5 is a rear view of an embodiment of the receiver of the present invention.
Figure 6:
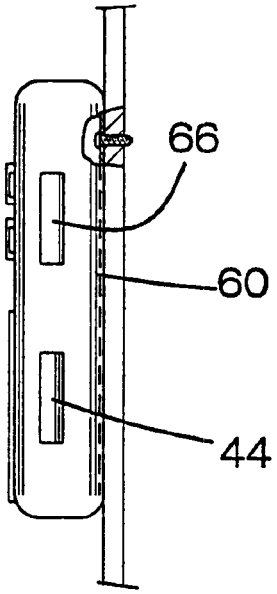
FIG. 6 is a side view of an embodiment of the receiver of the present invention.
Figure 7:
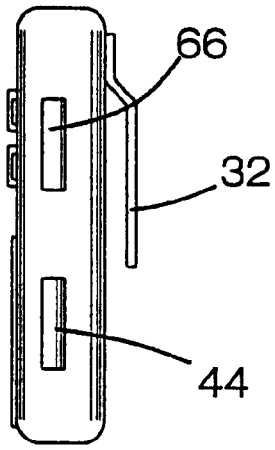
FIG. 7 is a side view of an embodiment of the receiver of the present invention.
Figure 8:
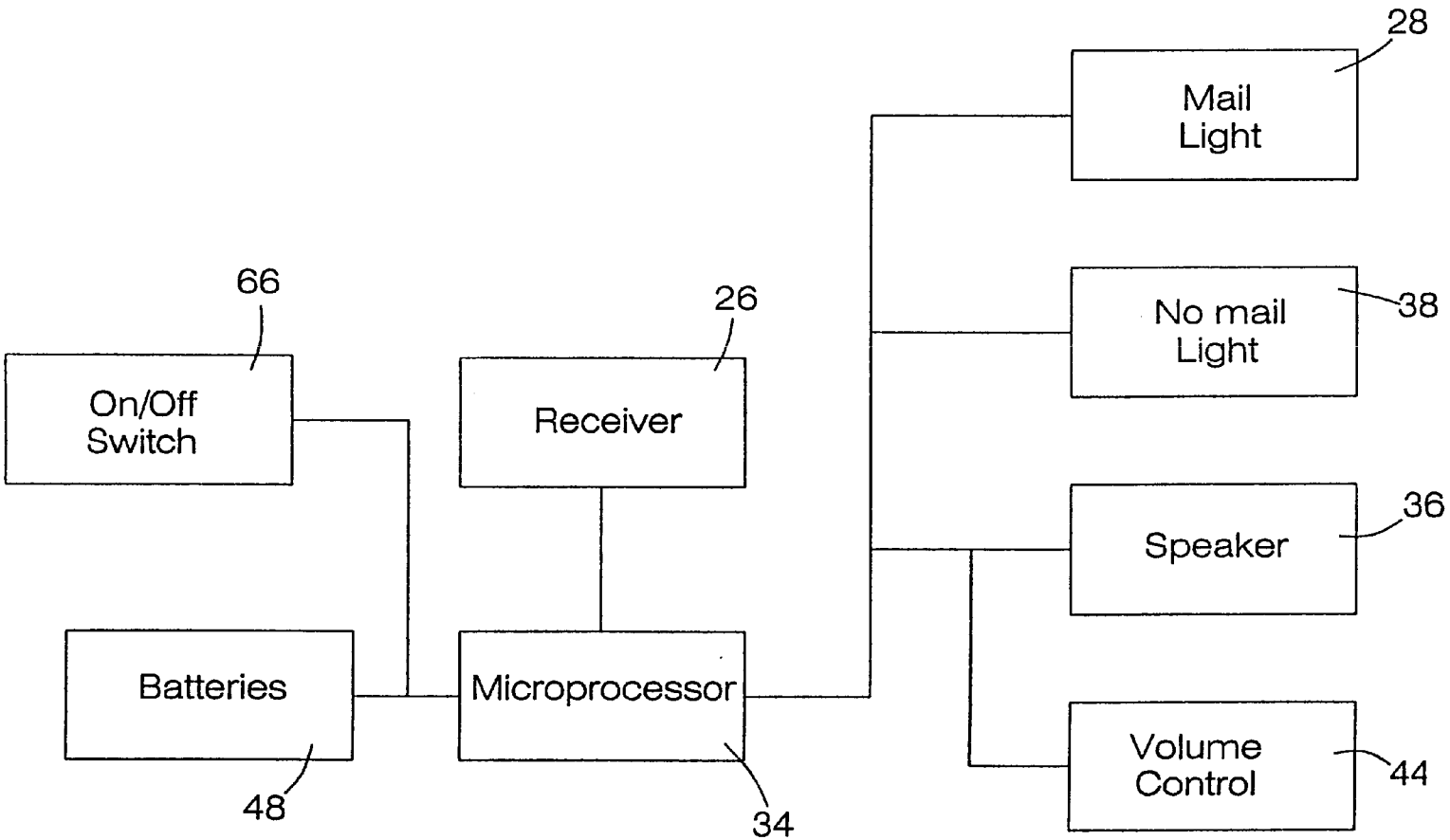
FIG. 8 is a block diagram of the present invention.
Figure 9:
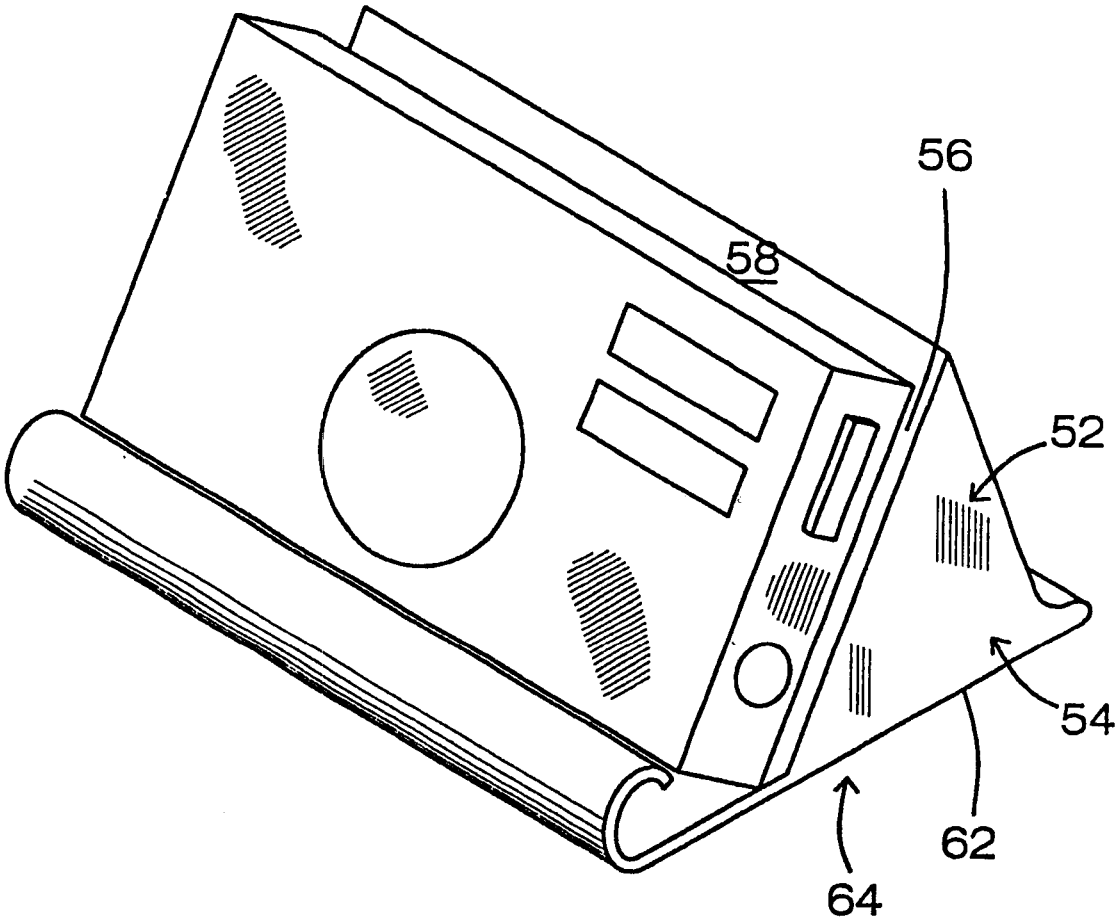
FIG. 9 is a perspective view of the present invention.

With reference now to the drawings, and in particular to FIGS. 1 through 9 thereof, a new electronic mail sensor embodying the principles and concepts of the present invention and generally designated by the reference numeral 10 will be described.

As best illustrated in FIGS. 1 through 9, the electronic mail sensor 10 generally includes a mailbox 12 that has an open end 14. A door 16 is coupled to the mailbox 12 for selectively covering the open end 14. A transmitter assembly 18 coupled to the mailbox 12 adjacent the open end 14, the transmitter assembly 18 includes a sensor 20 for detecting the door 16 is in an open position. The transmitter assembly 18 further includes a transmitter 22 operationally coupled to the sensor 20 for transmitting a signal when the door 16 is in an open position. A receiver assembly 24 includes a receiver 26 for receiving the signal, the receiver assembly 24 includes a mail indicating light 28 operationally coupled to the receiver 26 such that the mail indicating light 28 is illuminated upon the receiver 26 receiving the signal.

The receiver assembly 24 includes a microprocessor 34 operationally coupled to the receiver 26. The receiver assembly 24 further includes a speaker 36 operationally coupled to the microprocessor 34, the speaker 36 is for transmitting an audible report upon the receiver 26 receiving the signal from the transmitter 22. The receiver assembly 24 further includes a no-mail indicating light 38, the no-mail indicating light 38 is operationally coupled to the receiver 26 such that the no-mail light 38 is illuminated upon activation of the receiver 26. The no-mail indicating light 38 is deactivated upon the receiver 26 receiving the signal from the transmitter 22. The receiver assembly 24 includes a microprocessor 34 operationally coupled to the receiver 26.

The mail indicating light 28 is operationally coupled to the microprocessor 34 such that the mail indicating light 28 flashes upon the receiver 26 receiving the signal from the transmitter 22.

An upper surface 40 of the transmitter housing 30 is designed for abutting an interior upper surface 42 of the mailbox 12 when the transmitter housing is coupled to the mailbox 12 using the clip member 68.

The transmitter housing 30 is prevented from obstructing access to a lower portion of an interior of the mailbox 12. A volume control 44 operationally coupled to the microprocessor 34 for permitting selection of a desired volume of the audible report.

The receiver assembly 24 includes a battery compartment 46 designed for holding batteries 48 for providing power to the receiver assembly 24. The receiver assembly 24 includes a receiver housing 50. A receiver stand 52 has a base portion 54 and a housing support portion 56, the housing support portion 56 has an angled front face 58 for abutting a rear face 60 of the receiver housing 50 when the receiver housing 50 is held in the receiver stand 52. The receiver stand 52 includes a well portion 62 adjacent a bottom of the front face 58 of the support portion 56, the well portion 62 is for receiving a bottom portion 64 of the receiver housing 50 when the receiver housing 50 is positioned against the support portion 56. The receiver assembly 24 includes an on/off switch 66 for selectively activating the receiver 26.

In use, a user would mount the transmitter assembly to the mailbox, or install the mailbox/transmitter assembly. The user would be notified by the receiver assembly when the mail has been delivered to the mailbox.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mail delivery indicating system comprising:

a mailbox having an open end;

a door coupled to said mailbox for selectively covering said open end;

a transmitter assembly coupled to said mailbox adjacent said open end, said transmitter assembly including a sensor for detecting said door being in an open position, said transmitter assembly further including a transmitter operationally coupled to said sensor for transmitting a signal when said door is in an open position;

a receiver assembly including a receiver for receiving said signal, said receiver assembly including a mail indicating light operationally coupled to said receiver such that said mail indicating light is illuminated upon said receiver receiving said signal; and said receiver assembly further including a no-mail indicating light, said no-mail indicating light being operationally coupled to said receiver such that said no-mail light is illuminated upon activation of said receiver, said no-mail indicating light being deactivated upon said receiver receiving said signal from said transmitter.

2. The mail delivery indicating system of claim 1, further comprising:

said transmitter assembly including a transmitter housing;

a clip member coupled to said transmitter housing, said clip member being for engaging said mailbox whereby said transmitter housing is coupled to said mailbox.

3. The mail delivery indicating system of claim 2, further comprising:

an upper surface of said transmitter housing being adapted for abutting an interior upper surface of the mailbox when the transmitter housing is coupled to the mailbox using said clip member whereby said transmitter housing is prevented from obstructing access to a lower portion of an interior of the mailbox.

4. The mail delivery indicating system of claim 1, further comprising:

said receiver assembly including a microprocessor operationally coupled to said receiver;

said receiver assembly further including a speaker operationally coupled to said microprocessor, said speaker being for transmitting an audible report upon said receiver receiving said signal from said transmitter.

5. The mail delivery indicating system of claim 4, further comprising:

a volume control operationally coupled to said microprocessor for permitting selection of a desired volume of said audible report.

6. The mail delivery indicating system of claim 1, further comprising:

said receiver assembly including a microprocessor operationally coupled to said receiver;

said mail indicating light being operationally coupled to said microprocessor such that said mail indicating light flashes upon said receiver receiving said signal from said transmitter.

7. The mail delivery indicating system of claim 1, further comprising:

said receiver assembly including a battery compartment adapted for holding batteries for providing power to said receiver assembly.

8. The mail delivery indicating system of claim 1, further comprising:

said receiver assembly including a receiver housing;

a receiver clip extending from said receiver housing, said receiver clip being adapted for coupling to a user.

9. The mail delivery indicating system of claim 1, further comprising:

said receiver assembly including a receiver housing;

a receiver stand having a base portion and a housing support portion, said housing support portion having an angled front face for abutting a rear face of said receiver housing when said receiver housing is held in said receiver stand.

10. The mail delivery indicating system of claim 9, further comprising:

said receiver stand including a well portion adjacent a bottom of said front face of said support portion, said well portion being for receiving a bottom portion of said receiver housing when said receiver housing is positioned against said support portion.

11. The mail delivery indicating system of claim 1, further comprising:

said receiver assembly including a receiver housing;

said receiver housing having a pair of hanging slots, each of said hanging slots being adapted for receiving a head portion of a connector coupled to a support structure whereby said receiver housing is mountable to the support structure.

12. The mail delivery indicating system of claim 1, further comprising:

said receiver assembly including an on/off switch for selectively activating said receiver.

13. A mail delivery indicating system comprising:

a mailbox having an open end;

a door coupled to said mailbox for selectively covering said open end;

a transmitter assembly coupled to said mailbox adjacent said open end, said transmitter assembly including a sensor for detecting said door being in an open position, said transmitter assembly further including a transmitter operationally coupled to said sensor for transmitting a signal when said door is in an open position;

a receiver assembly including a receiver for receiving said signal, said receiver assembly including a mail indicating light operationally coupled to said receiver such that said mail indicating light is illuminated upon said receiver receiving said signal;

said transmitter assembly including a transmitter housing;

a clip member coupled to said transmitter housing, said clip member being for engaging said mailbox whereby said transmitter housing is coupled to said mailbox;

said receiver assembly including a microprocessor operationally coupled to said receiver;

said receiver assembly further including a speaker operationally coupled to said microprocessor, said speaker being for transmitting an audible report upon said receiver receiving said signal from said transmitter;

said receiver assembly further including a no-mail indicating light, said no-mail indicating light being operationally coupled to said receiver such that said no-mail light is illuminated upon activation of said receiver, said no-mail indicating light being deactivated upon said receiver receiving said signal from said transmitter;

said receiver assembly including a microprocessor operationally coupled to said receiver;

said mail indicating light being operationally coupled to said microprocessor such that said mail indicating light flashes upon said receiver receiving said signal from said transmitter;

an upper surface of said transmitter housing being adapted for abutting an interior upper surface of the mailbox when the transmitter housing is coupled to the mailbox using said clip member whereby said transmitter housing is prevented from obstructing access to a lower portion of an interior of the mailbox;

a volume control operationally coupled to said microprocessor for permitting selection of a desired volume of said audible report;

said receiver assembly including a battery compartment adapted for holding batteries for providing power to said receiver assembly;

said receiver assembly including a receiver housing;

a receiver stand having a base portion and a housing support portion, said housing support portion having an angled front face for abutting a rear face of said receiver housing when said receiver housing is held in said receiver stand;

said receiver stand including a well portion adjacent a bottom of said front face of said support portion, said well portion being for receiving a bottom portion of said receiver housing when said receiver housing is positioned against said support portion; and said receiver assembly including an on/off switch for selectively activating said receiver.

14. The mail delivery indicating system of claim 13, further comprising:

said receiver housing having a pair of hanging slots, each of said hanging slots being adapted for receiving a head portion of a connector coupled to a support structure whereby said receiver housing is mountable to the support structure.

15. The mail delivery indicating system of claim 13, further comprising:

a receiver clip extending from said receiver housing, said receiver clip being adapted for coupling to a user.

* * * * *